US005757932A

United States Patent [19]

Lindemann et al.

[11] Patent Number: 5,757,932

[45] Date of Patent: *May 26, 1998

[54] DIGITAL HEARING AID SYSTEM

[75] Inventors: Eric Lindemann; John L. Melanson, both of Boulder, Colo.; Nikolai Bisgaard, Lyngby, Denmark

[73] Assignee: AudioLogic, Inc., Boulder, Colo.

[ * ] Notice: The term of this patent shall not extend beyond the expiration date of Pat. No. 5,479,522.

[21] Appl. No.: 542,158

[22] Filed: Oct. 12, 1995

Related U.S. Application Data

[63] Continuation-in-part of Ser. No. 123,499, Sep. 17, 1993, Pat. No. 5,479,522.

[51] Int. Cl.[6] ..... H04R 25/00

[52] U.S. Cl. ..... 381/68; 381/68.2

[58] Field of Search ..... 381/68, 68.1, 68.2, 381/68.4, 68.6, 68.7, 69, 69.2; 128/746

[56] References Cited

U.S. PATENT DOCUMENTS

| | | | |
|---|---|---|---|
| 3,509,289 | 4/1970 | Briskey et al. | 179/107 |
| 3,894,196 | 7/1975 | Briskey | 381/68.6 |
| 4,531,229 | 7/1985 | Coulter | 381/68 |
| 5,027,410 | 6/1991 | Williamson et al. | 381/68.4 |
| 5,144,674 | 9/1992 | Meyer et al. | 381/68.4 |
| 5,204,917 | 4/1993 | Arndt et al. | 381/69 |
| 5,276,739 | 1/1994 | Krokstad et al. | 381/68.4 |
| 5,325,436 | 6/1994 | Soli et al. | 381/68 |
| 5,479,522 | 12/1995 | Lindemann et al. | 381/68.4 |

FOREIGN PATENT DOCUMENTS

| | | | |
|---|---|---|---|
| 8809105 | 11/1988 | WIPO | 381/68 |
| WO 89/04583 | 5/1989 | WIPO | H04R 25/00 |

OTHER PUBLICATIONS

Knowles Electronics, Inc. Data Sheet, EB Series, pp. 1–4.

Fred Waldhauer et al., "Full Dynamic Range Multiband Compression In a Hearing Aid", The Hearing Journal, Sep. 1988, pp. 1–4.

*Primary Examiner*—Huyen Le

*Attorney, Agent, or Firm*—Fenwick & West LLP

[57] ABSTRACT

A detachable digital binaural processing hearing aid comprised of a digital signal processor (DSP), two microphones, two receivers, a bi-directional communications link between each microphone/receiver and the digital signal processor, an analog-to-digital converter, and a digital-to-analog converter. In one embodiment of the present invention, the user has the option of disabling the digital signal processor by either physically removing an external digital processing unit or by disabling a digital processor to permit an analog processor to provide audio enhancement. The user is also given the option of selecting from a variety of digital filters/compressors that generate binaural signals that are sent to both ears of the user. In a second embodiment, each hearing element comprises a digital signal processor and a communication link to the other hearing element. Two examples of the communication link are an electrical wire connecting the two hearing elements and a electromagnetic transceiving system where each hearing element has a transceiver that transmits a signal representing the sound at one ear of the user and receives a signal representing the sound at the other ear of the user.

21 Claims, 8 Drawing Sheets

DIGITAL HEARING AID SYSTEM

RELATED PATENT APPLICATION

This patent application is a continuation-in-part of U.S. patent application Ser. No. 08/123,499, filed on Sep. 17, 1993, U.S. Pat. No. 5,479,522 entitled "Binaural Hearing Aid".

BACKGROUND OF THE INVENTION

1. Field of the Invention

The present invention relates generally to the field of hearing aid devices, particularly to digital hearing aid systems and methods.

2. Description of Background Art

Traditional analog hearing aids provide frequency dependent gain and dynamic range compression to compensate for a variety of hearing impairments. Although analog hearing aids are helpful in many cases, users of state-of-the-art analog hearing aids still complain of poor performance. One complaint is the difficulty in understanding speech in noisy environments, e.g., in restaurants. Other complaints involve problems with feedback (especially for hearing aids with high gain) difficulty localizing sounds, and a general lack of clarity in sound perception.

The advent of digital signal processing provides the possibility for significant improvements in hearing aid functionality. However, the design of a digital signal processing system that is affordable, is small enough to fit within a conventional hearing aid, provides a wide range of functions, and can operate without requiring significant power is still a significant limitation in these hearing aid systems.

Some digital signal processing systems permit binaural amplification and filtering. The processing of sounds by two ears is referred to as binaural hearing. In binaural hearing aids, the sound generated by a binaural processor is dependent upon the sounds received at both ears, not just one ear. Binaural hearing aids have many benefits. The localization of sound in space, for instance, is largely a binaural phenomenon. A sound originating on the right side of a listener, for example, will arrive first at the right ear because it is closer to the sound source. A short time later, the sound will reach the more distant left ear. This produces an interaural (between ear) difference in the time of arrival of the sound at the two ears. The ear that is stimulated first will signal the direction from which the sound arose. As might be expected, the magnitude of this interaural time difference will increase as the location of the sound source changes from straight ahead, with respect to direction the user is facing, to straight out to either side of the user direction. When sound originates directly in front of the user, the length of the path to both ears is the same, and there is no interaural difference in the time of arrival of the sound. At the extreme right or left of the direction the user is facing the difference between the length of the path to the near ear and the length of the path to the far ear is greatest, and will produce the maximum interaural time difference.

For some frequencies, the interaural time difference can also be encoded into an interaural phase difference, e.g., using complex phase differentials. A general description of interaural phase differences is given in Bess and Humes, *Audiology, The Fundamentals* (2d Ed., 1995) that is hereby incorporated by reference in its entirety.

As described above, binaural hearing requires that a processor receive sounds, or signals representing sounds, captured at both ears. In contrast to monaural hearing that only requires the processing of sounds received at a single ear. Therefore, another requirement for a digital binaural hearing aid is that a digital signal processor receive signals representing sounds that are received at each ear.

Accordingly, what is needed is a hearing aid system and method that provides a digital signal processor that is small enough to fit within a conventional hearing aid, operates in "low" power environments, permits the digital signal processor to receive representations of sounds that are received at each ear, and transmits a binaural output to both ears of a user.

SUMMARY OF THE INVENTION

The invention is a detachable digital binaural processing hearing aid comprised of a digital signal processor (DSP), two microphones, two receivers, a bi-directional communications link between each microphone/receiver and the digital signal processor, an analog-to-digital converter, and a digital-to-analog converter. In one embodiment of the present invention, the user has the option of disabling the digital signal processor by either physically removing an external digital processing unit or by disabling a digital processor to permit an analog processor to provide audio enhancement. The user is also given the option of selecting from a variety of digital filters/compressors that generate binaural signals that are then sent to one or both ears of the user. In a second embodiment, each hearing element comprises a digital signal processor and a communication link to the other hearing element. Two examples of the communication link are an electrical wire connecting the two hearing elements and a electromagnetic transceiving system where each hearing element has a transceiver that transmits a signal representing the sound at one ear of the user and receives a signal representing the sound at the other ear of the user.

DETAILED DESCRIPTION OF THE PREFERRED EMBODIMENTS

A preferred embodiment of the present invention is now described with reference to the figures where like reference numbers indicate identical or functionally similar elements. Also in the figures, the left most digit of each reference number corresponds to the figure in which the reference number is first used.

Figure 1:
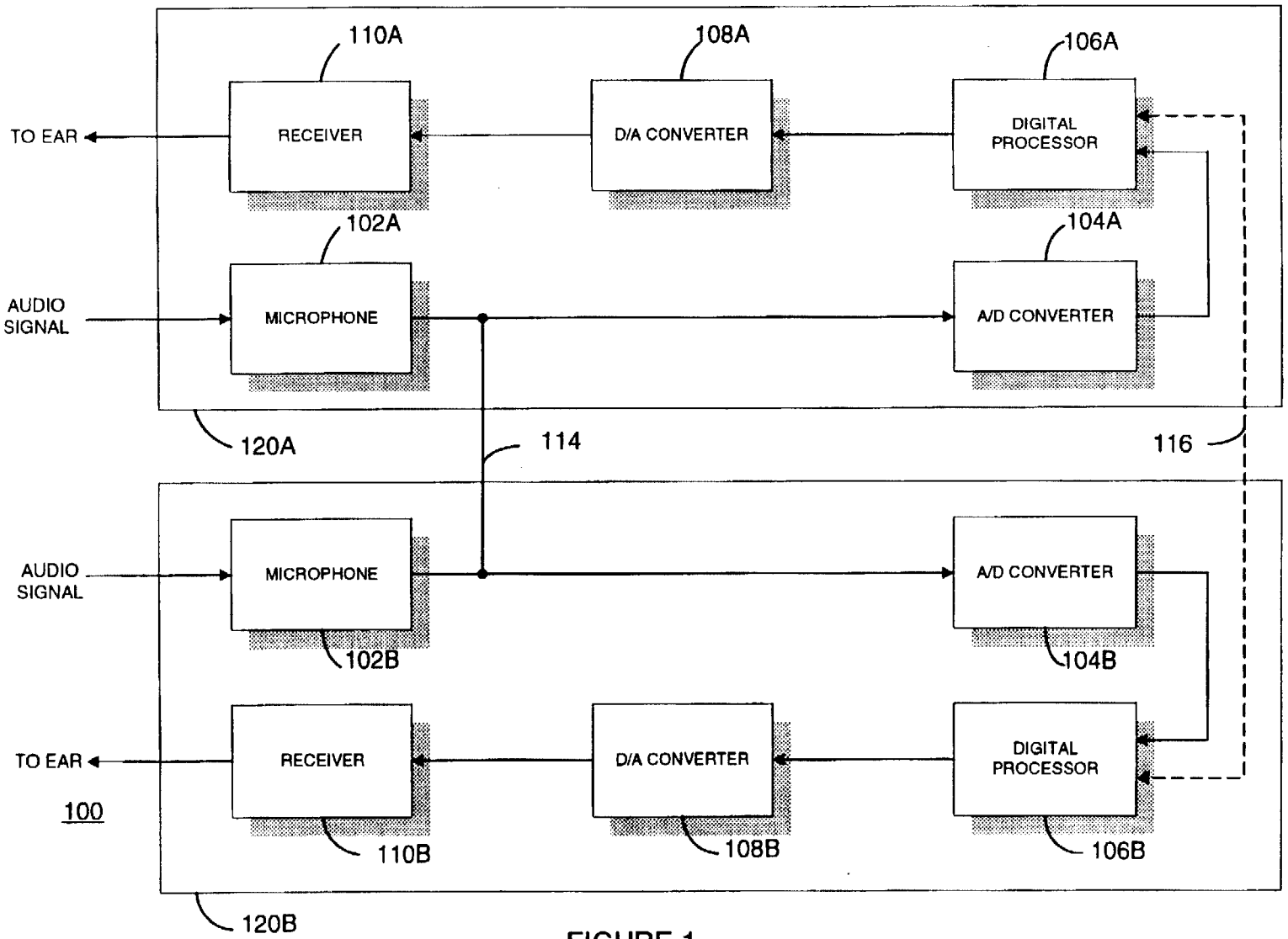
FIG. 1 is a functional block diagram of a hearing aid system according to a preferred embodiment of the present invention where each hearing element comprises a digital processor.

FIG. 1 is a functional block diagram of a hearing aid system 100 according to a preferred embodiment of the present invention where each hearing element 120 comprises a digital processor 106. One hearing element 120 is adjacent to each ear of a user. Three conventional locations for the hearing element 120 are: (1) behind the ear, (2) in the ear, and (3) in the ear canal. The present invention will operate in, at least, these three positions. However, in the preferred embodiment each hearing element 120 is located behind a user's ear. Each hearing element 120 comprises a microphone 102, an analog-to-digital (A/D) converter 104, a digital processor 106, a digital-to-analog (D/A) converter 108 and a receiver 110. An audio signal or sound is received by a microphone 102. The present invention utilizes a conventional microphone 102, e.g., part number EB 1863 (Directional Microphone), that is commercially available from Knowles Electronics, Inc. Itasca, Ill. The microphone 102 converts the audio signal to an unprocessed analog signal. The unprocessed analog signal generated by microphone 102A is transmitted to the A/D converter 104A within the first hearing element 120A and is also transmitted to the A/D converter 104B located within the second hearing element 120B via a communication link 114. Similarly, the unprocessed analog signal generated by the microphone 102B in the second hearing element 120B is transmitted to the A/D converter 104B within the second hearing element 120B and is also transmitted to the A/D converter 104A located within the first hearing element 120A via a communication link 114. Accordingly, since two analog signals are received by the A/D converter 104, the A/D converter 104 is either a stereo A/D converter 104 or a combination of two single signal A/D converters. In the preferred embodiment the A/D converter is a stereo A/D converter (referred to herein as A/D converter 104). The communication link is preferably a conventional wire. The unprocessed analog signals are converted to digital signals in the A/D converter 104. The A/D converter 104 generates an unprocessed digital signal that is transmitted to the digital processor 106.

The digital processor 106 receives the unprocessed digital signal and utilizes at least one of a plurality of processing techniques to generate a processed digital signal representing an enhanced signal. Two digital signal processing techniques are a binaural beam forming noise reduction technique and a dynamic range compression technique. Several binaural beam forming noise reduction techniques are described in U.S. patent application Ser. No. 08/123,503, titled "Noise Reduction System for Binaural Hearing Aid" by Lindemann et al., filed on Sep. 17, 1993, and in U.S. patent application Ser. No. 08/184,724, titled "Dynamic Intensity Beamforming System for Noise Reduction in a Binaural Hearing Aid" by Lindemann et al., filed on Apr. 20, 1994, which are both incorporated by reference herein in their entirety. A dynamic range compression technique is described in U.S. patent application titled "Digital Signal Processing Hearing Aid" by Melanson and Lindemann, filed on Oct. 10, 1995 and an article by Waldhauer et al. "Full Dynamic Range Multiband Compression in a Hearing Aid", The Hearing Journal, pp. 1–4 (September 1988), which are both incorporated by reference herein in their entirety. An example of the architecture of the hearing aid system components, including the transceiver 302, A/D converter 104, digital processor 106, D/A converter 108, and receiver 110 is described in U.S. patent application Ser. No. 08/123,499, titled "Binaural Hearing Aid" by Lindemann et al., filed on Sep. 17, 1993, that is incorporated by reference herein in its entirety.

The beamforming digital processing technique attenuates sounds whose source is not directly in front of the user and amplifies those sounds whose source is directly in front of the user, i.e., the direction the user is looking. In general, sound is received at the microphones 102 located adjacent to each ear of the user. The microphone generates an analog signal representing sounds. This signal is divided into frequency bands, e.g., 128 frequency (filter) bands, by the digital processor 106. When operating in the beamforming mode, the digital processor 106 compares the signals received at each ear and amplifies the digital representation of sounds that originate directly in front of the user and attenuates the digital representation of all other sounds.

The digital processor 106 generates a processed digital signal that is received by a D/A converter 108. When the digital processor performs binaural processing, the processed digital signal represents the filtered sound that is present at the hearing element 120. The D/A converter 108 converts the processed digital signal to a processed analog signal that is received by a receiver 110. The receiver 110 transforms the processed analog signal to a processed audio signal, i.e., sound. The sound is then sent to the ear of the user.

Figure 2:
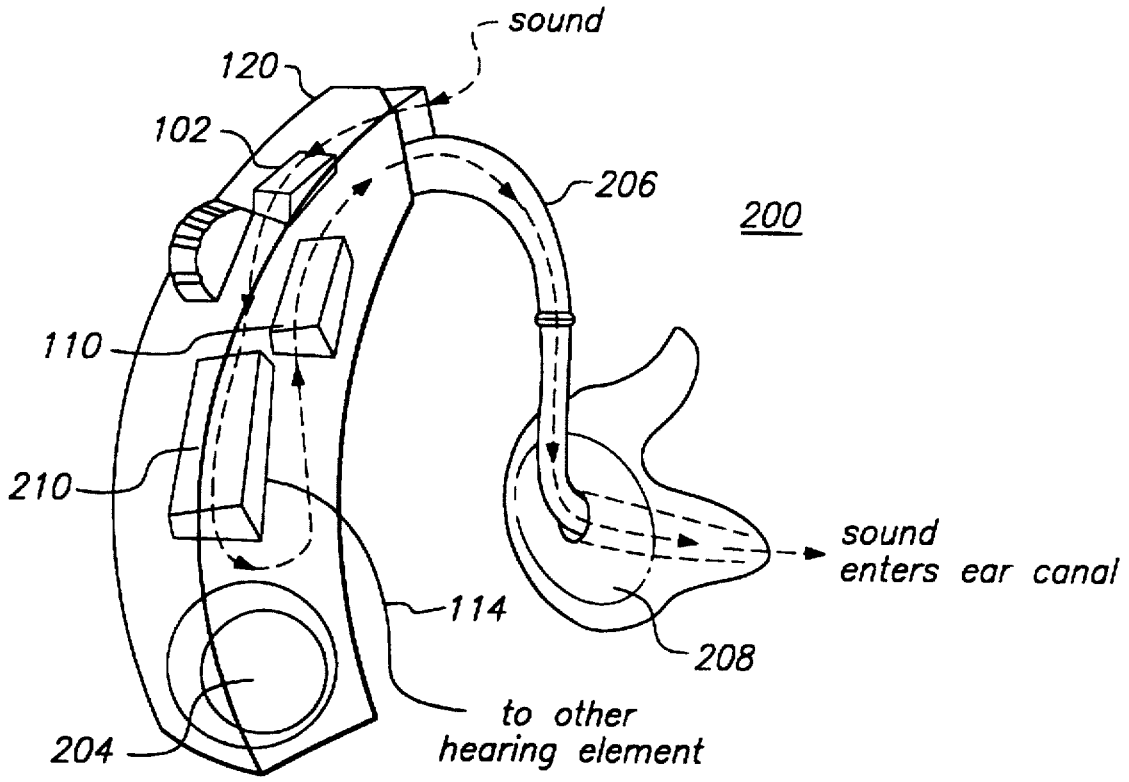
FIG. 2 is an illustration of the hearing aid system shown in FIG. 1 according to a preferred embodiment.
Figure 5:
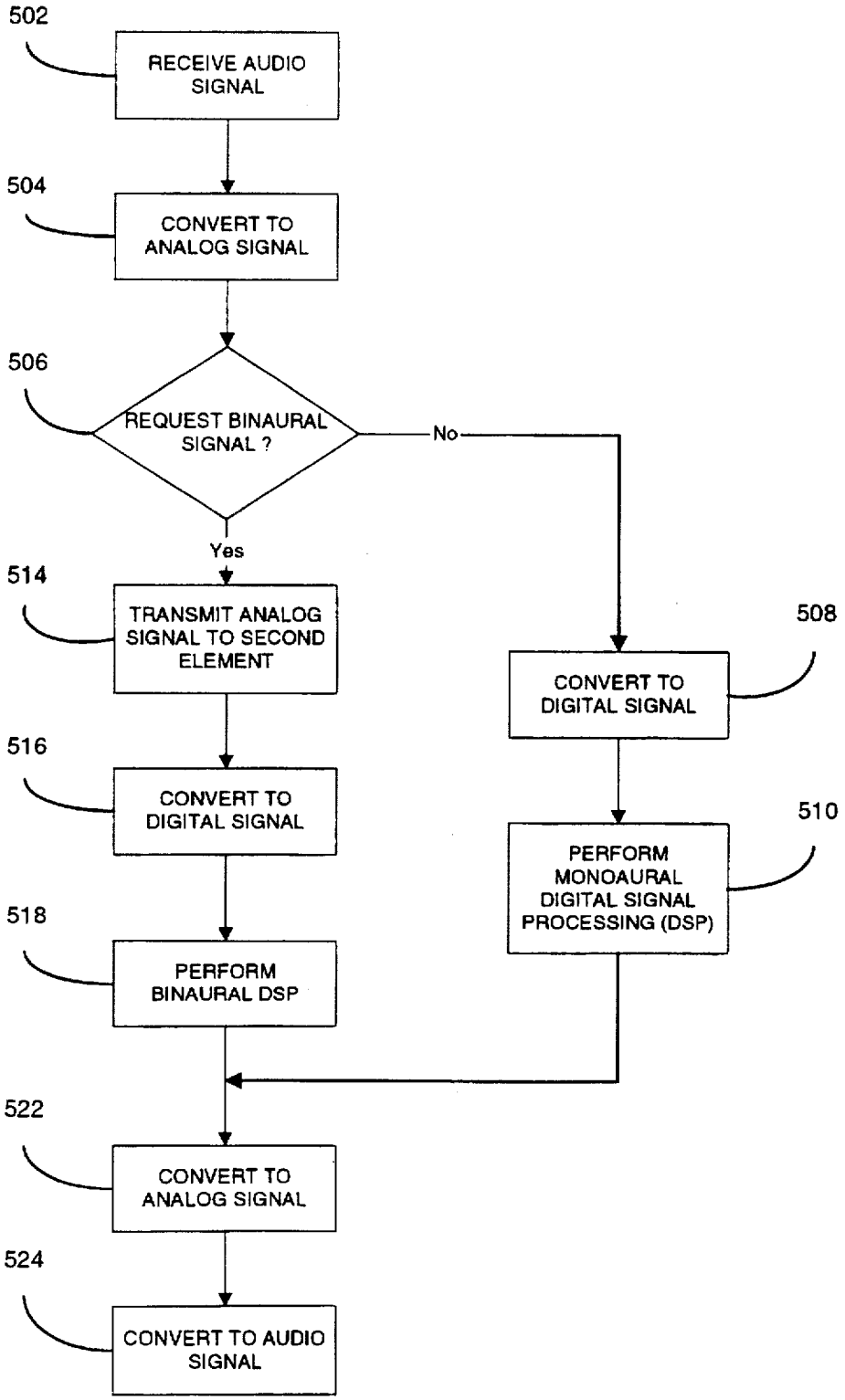
FIG. 5 is a flowchart describing the method of the preferred embodiment shown in FIGS. 1–4.

FIG. 2 is an illustration of a hearing aid system 200 of FIG. 1. The hearing aid system 200 includes a hearing element 120, a communication link 114, conventional sound tubing 206, and a conventional ear mold 208. The hearing element 120 includes a microphone 102, a power supply 204, e.g., a battery, a receiver 110, and a digital converter/processor (DCP) 210 that includes an A/D converter 104, a digital processor 106 and a D/A converter 108. The operation of the hearing aid system 200 of FIG. 2 is now described with reference to FIG. 5. Sound enters the hearing element 120 and is received 502 by the microphone 102. The microphone 102 converts 504 the sound to an unprocessed analog signal that is sent to the DCP 210. Initially, the DCP 210 converts 504 the unprocessed analog signal to an unprocessed digital signal. Then the DCP 210 determines 506 whether it will generate a binaural or monaural signal. Typically, this determination 506 is a result of a decision by a user. If a monaural signal is requested, the DCP 210 converts 508 the unprocessed analog signal to an unprocessed digital signal. This unprocessed digital signal typically does not contain data representative of sounds received by the other hearing element. The DCP 210 performs 510 monaural digital signal processing on the unprocessed digital signal and generates a processed digital signal. An example of a monaural digital signal processing technique is described in the article by Waldhauer et al. "Full Dynamic Range Multiband Compression in a Hearing Aid", The Hearing Journal, pp. 1–4 (September 1988), that was incorporated by reference above. The processed digital signal is converted 522 into a processed analog signal by the DCP 210 and is then converted 524 to a processed audio signal by the receiver 110. The audio signal is sent through the sound tubing 206 to the ear mold 208 and into the ear of the user.

If the user requests 506 the generation of a binaural signal, the unprocessed analog signal from the first hearing element 120A is transmitted to the second hearing element 120B and the unprocessed analog signal from the second hearing element 120B is transmitted to the first hearing element 120A. The unprocessed analog signals represent the sounds received at both hearing elements 120. The unprocessed analog signals are converted 516 to unprocessed digital signals in the DCP 210. The DCP 210 then performs binaural digital signal processing on the unprocessed digital signals to generate processed digital signals. In a preferred embodiment, both hearing elements 210 contain similar DCPs 210. In this embodiment therefore, there is no need for the processed digital signals in the first hearing element 120A to be sent to the second hearing element 120B. Accordingly, the processed digital signals represent the binaural sound that is to be received by the ear at which the first hearing element 120A is located. In the second hearing element 120B, the processed digital signals represent the binaural sound that is to be received by the ear at which the second hearing element 120B is located. The DCP 210 converts 522 the processed digital signals to a processed analog signal. The processed analog signal is then converted 524 to an audio signal by the receiver. The audio signal, i.e., sound, is transmitted to the ear via the sound tubing 206 and the ear mold 208, as described above.

In an alternate embodiment, the functions performed by the digital processor in the preferred embodiment are partitioned into each of the two digital processors 106A, 106B. That is, some of the functions are performed by the digital processor 106A in the first hearing element 120A, and the remaining functions are performed by the digital processor 106B in the second hearing element 120B. The benefits of such a system include a reduction in the size, power consumption, and processing time required for each digital processor. Many different functional partitioning schemes can be implemented. These schemes include, performing filtering functions in the first digital processor 106A and performing the compression and comparison functions in the second digital processor 106B. Another partitioning scheme involves using a single digital processor 106 in the first hearing element 120A and placing the power supply 204 in the second hearing element 120B. In another partitioning scheme, each hearing element 120 includes a digital processor 106 having full functionality. However, instead of having each processor perform all functions on all signals, each processor only processes a portion of the signals, e.g., the first digital processor 106A processes all even filter bands, while the second digital processor 106B processes all odd filter bands.

In some of the above alternate embodiments, neither digital processor 106 performs all of the necessary functions on all of the signals. Therefore, the two hearing elements 120 must be able to communicate with each other after the signals have been processed by the digital processor 106. To accommodate this requirement a digital bi-directional communication link 116, shown in FIG. 1, couples the digital processor 106A in the first hearing element 120A and the digital processor 106B in the second hearing element 120B. Therefore, the digital processors 106 exchange processed information, e.g., the first digital processor 106A will transmit the processed signals representing the even filter bands to the second digital processor 106B and the second digital processor 106B will transmit the processed signals representing the odd filter bands to the first digital processor 106A. If the partition of the functions is such that some functions are performed on all signals by the first digital processor 106A and the remaining functions are performed by the second digital processor 106B, the second digital processor 106B will transmit the unprocessed digital signals to the first digital processor 106A. After processing the signals, the first digital processor will transmit the partially-processed signals to the second digital processor 106B for processing. The fully processed signals are then transmitted back to the first digital processor 106A.

Figure 3:
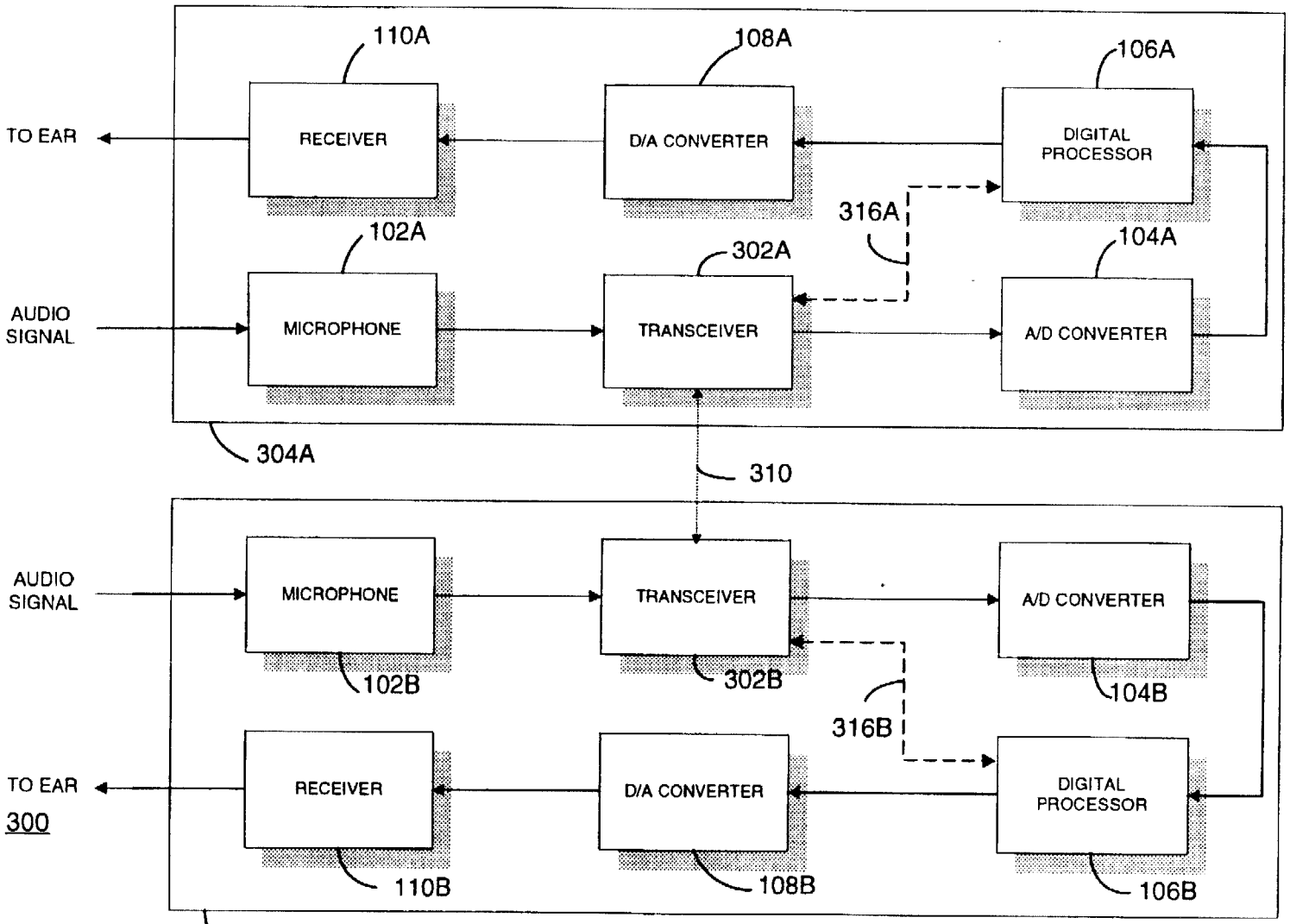
FIG. 3 is a functional block diagram of a hearing aid system according to a preferred embodiment of the present invention where each hearing element comprises a digital processor.

FIG. 3 is a functional block diagram of a hearing aid system 300 according to a preferred embodiment of the present invention where each hearing element comprises a digital processor. In contrast to the hearing aid system 100 illustrated in FIG. 1, each hearing element 304 in an alternate embodiment of the present invention illustrated in FIG. 3 includes a electromagnetic transceiver 302 that is described above. In addition, each hearing element 304 includes the following components, a microphone 102, and A/D converter 104, a digital processor 106, a D/A converter 108, and a receiver 110. These components are described in greater detail above. The hearing elements 304 operate in a manner that is similar to the hearing elements 120 described above with reference to FIG. 1. One difference in operation is that instead of transmitting a signal across a physical communication link, 114, 116, the unprocessed and processed analog signals from the first hearing element 304A are transmitted to the second hearing element 304B using electromagnetic signals, i.e., without a physical link.

Figure 4:
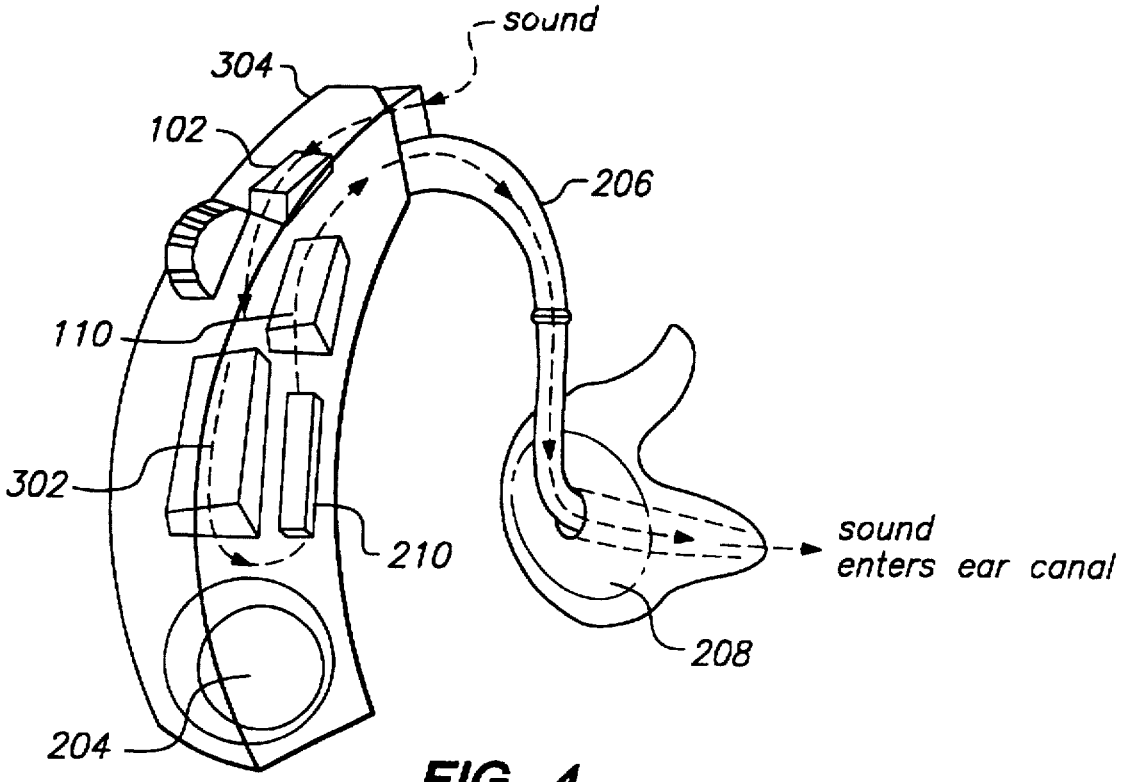
FIG. 4 is an illustration of the hearing aid system shown in FIG. 3 according to a preferred embodiment.

FIG. 4 is an illustration of a hearing element 304 set forth in FIG. 3. The functioning of the hearing aid system 300 is now described with reference to FIG. 5. The hearing element 304 receives 502 an audio signal, i.e., sound. The audio signal is converted 504 to an unprocessed analog signal by the microphone 102. The DCP 210 determines 506 whether it will generate a binaural or monaural signal. Typically, this determination 506 is a result of a decision by a user. If a monaural signal is requested, the transceiver 302 is not used, instead the DCP 210 converts 508 the unprocessed analog signal to an unprocessed digital signal. This unprocessed digital signal typically does not contain data representative of sounds received by the other hearing element. The DCP 210 performs 510 monaural digital signal processing on the unprocessed digital signal and generates a processed digital signal, as described above. The processed digital signal is converted 522 to a processed analog signal by the DCP 210 and is then converted 524 to an audio signal by the receiver 110. The audio signal is sent through the sound tubing 206 to the ear mold 208 and into the ear of the user.

If the user requests 506 the generation of a binaural signal, the unprocessed analog signal at the first hearing element 120A is transmitted 514 to the second hearing element 120B via the transceiver 302A over the non-physical communications path 310. Similarly, the unprocessed analog signal from the second hearing element 120B is received by the current hearing element 120 via the transceiver 302A over the non-physical communications path 310. The unprocessed analog signals represent the sounds received at both hearing elements 120. The unprocessed analog signal is converted 516 to an unprocessed digital signal in the DCP 210. Thereafter, the DCP 210 performs binaural digital signal processing on the unprocessed digital signal to generate a processed digital signal. In a preferred embodiment, both hearing elements 210 contain similar DCPs 210. In this embodiment therefore, it is not required that the processed digital signal in the first hearing element 120A be sent to the second hearing element 120B. Similarly, it is not required that the processed digital signal in the second hearing element 120B be sent to the first hearing element 120A. Accordingly, the processed digital signal generated by the digital processor 106A represents the binaural sound that is to be received by the ear at which the first hearing element 120A is located. In the second hearing element 120B, the processed digital signal represents the binaural sound that is to be received by the ear at which the second hearing element 120B is located. The DCP 210 converts 522 the processed digital signal to a processed analog signal. The processed analog signal is converted 524 to an audio signal by the receiver 110. The audio signal, i.e., sound, is then transmitted to the ear via the sound tubing 206 and the ear mold 208, as described above.

Alternate embodiments of the hearing element 304 having a transceiver 302 include the different partitioning schemes for the digital processor 106 functions described above with respect to FIG. 1. In these alternate embodiments, signals are transmitted between the hearing elements 120 via the transceivers 302 using electromagnetic signals, instead of using a communications link 114, 116. In addition, each transceiver 302 is coupled to each digital processor 106 via an internal digital link 316 to permit the processed digital signals to be transmitted between the hearing elements 120.

In another alternate embodiment the communication link 114, 116, 310 is digital and carries the unprocessed and processed digital signal from each hearing element 120 to the other hearing element 120. Accordingly, in this embodiment the communication link 114 in FIG. 1 is coupled to the output of the A/D converters 104A, 104B. An additional benefit of this alternate embodiment is that only a single signal A/D converter is necessary, instead of a stereo A/D converter 104 since each unprocessed analog signal is converted to a digital signal before being transmitted to the other hearing element 120. In the embodiment described in FIG. 3, the transceiver, e.g., 302A, receives the unprocessed digital signals from the A/D converter 104A and transmits the unprocessed digital signals to the transceiver 302B in the second hearing element 120B, and to the digital processor 106A in the first hearing element 120A.

Figure 6:
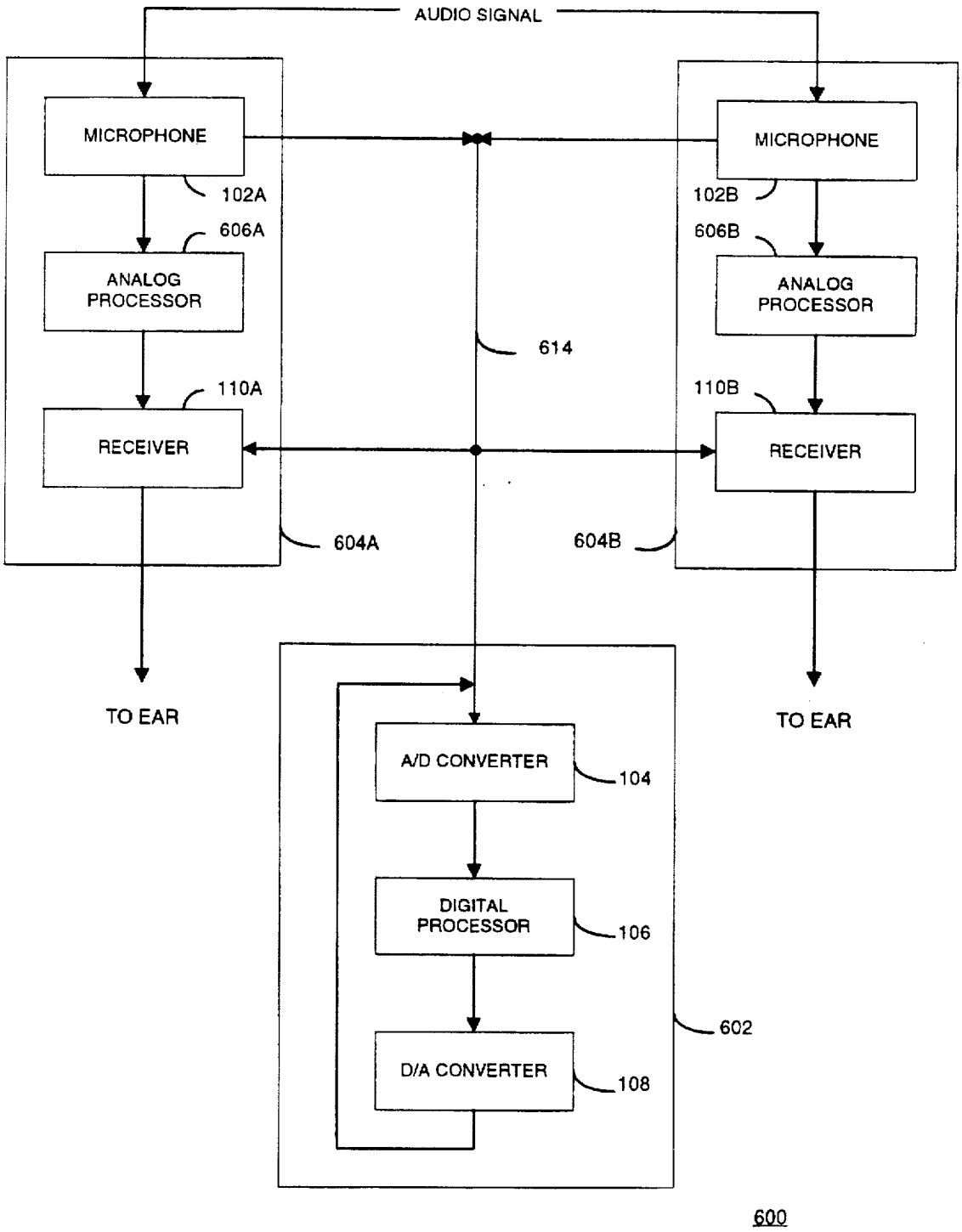
FIG. 6 is a functional block diagram of a hearing aid system according to a preferred embodiment of the present invention where a digital processor is external to each hearing element and is physically connected to each hearing element.

FIG. 6 is a functional block diagram of a hearing aid system 600 according to a preferred embodiment of the present invention where a digital processor is external to each hearing element 120 and is physically connected to each hearing element 120. The hearing aid system 600 comprises an external digital processing unit 602, two hearing elements 604A, 604B, and a communications link 614. Each hearing element comprises a microphone 102, a conventional analog processor 606 and a receiver 110, described above. The external digital processing unit comprises an A/D converter 104, a digital processor 106 and a D/A converter 108. Conventional analog processors are capable of simple frequency filtering and multi-band dynamic range compression.

Figure 8B:
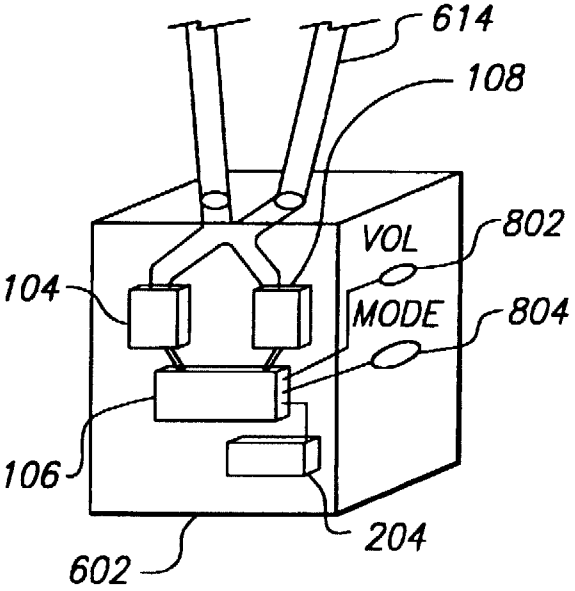
FIG. 8 is an illustration of an external digital processing unit according to a preferred embodiment.
Figure 8A:
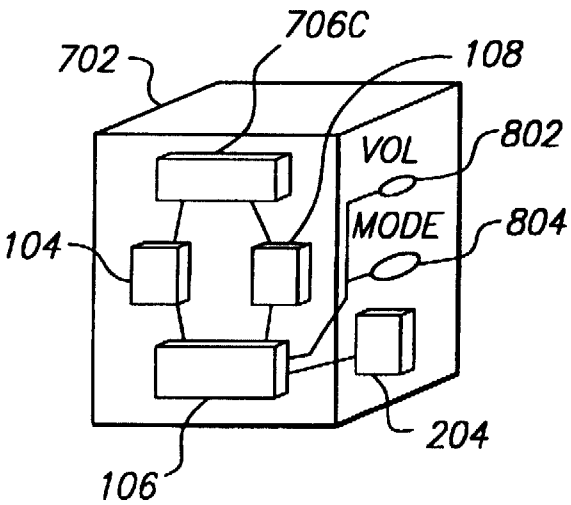

FIG. 8(*b*) is an illustration of an external digital processing unit 602 according to FIG. 6. The external digital processing unit 602 comprises an A/D converter 104, a digital processor 106, and a D/A converter, as described above. In addition, the external digital processing unit 602 includes a power supply 204, e.g., a battery, and two control switches: volume 802, and mode 804. The volume switch 802 controls the strength of the processed signal. The mode switch 804 permits the user to easily choose between the processing modes of the digital processor 106. Examples of the processing modes include: (1) noise reduction mode; (2) 2 and/10 band compression mode; and (3) high pass or flat pass frequency response mode. The communication link can include wires that form a "necklace" around the neck of a user in which the communication link 614 splits, preferably in the back of the user's neck, to connect each hearing element 604 to the external digital processing unit 602. The external digital processing unit is small in size, that is, it is approximately 1 inch in length, 1.5 inches in height, and 0.375 inches in depth. Accordingly, it is envisioned that the external digital processing unit 602 can be worn as a "medallion" on the chest of a user while being supported by the communication link wires 614 around the neck of the user. Similarly, the external digital processing unit 602 can be inconspicuously placed behind the neck or adjacent to the back of the user with a communication link 614 connecting the external digital processing unit to each of the hearing elements 604.

Figure 9:
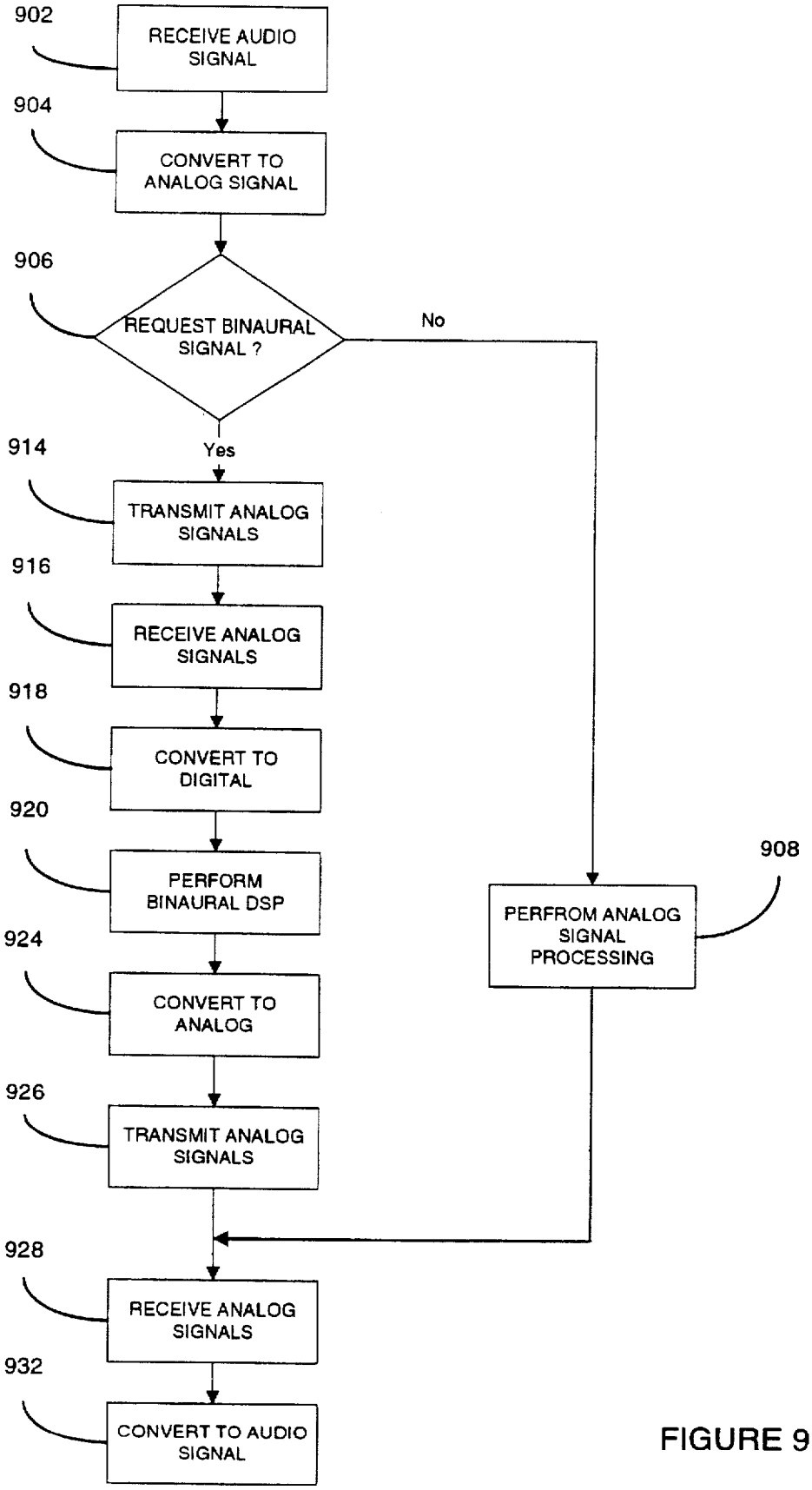
FIG. 9 is a flowchart describing the method of the preferred embodiment shown in FIGS. 6–7.

The technique for operating the hearing aid system 600 of FIG. 6 is given with reference to FIG. 9. The microphones 102A, 102B receive 902 audio signals. The microphones 102A, 102B are positioned in their respective hearing elements 604A, 604B adjacent to each ear of the user. The microphones 102A, 102B convert 904 the audio signal to an analog signal. A controller (not shown) in each hearing element 604 determines if the external digital processing unit 602 is connected to the hearing elements 604 and if the user has selected a digital binaural processing option. If both of these requirement are not satisfied, each hearing element 604 transmits the unprocessed analog signal to an internal analog processor 606. The analog processor 606 processes 908 the signal and transmits 928 a signal to the receiver 110. The receiver 110 converts 932 the processed analog signals to processed audio signals that are output to the ear of the user.

A feature of the present invention is that a user can choose to bypass the digital processor 106 and, instead, use the conventional analog processor 606. As discussed above, when a user is in a noisy environment, a digital processing hearing aid system is generally more effective when compared to an analog processing hearing aid system. However, digital processing systems are not always necessary or desired. The present invention provides the user with the option of choosing which processing system to use, i.e., analog or digital. In addition, the external digital processing unit 602 is detachable from the hearing elements 604 and is therefore not necessary when only analog processing is required. The communication link 614 can be easily de-coupled from the hearing element 604 without any detriment to the analog processing capabilities of the hearing element 604.

If a user chooses the digital binaural processing feature, each hearing element 604A, 604B transmits 914 the unprocessed analog signals to the A/D converter 104 in the external digital processing unit 602 via the communication link 614. The material used for the communication link is described above with reference to the communication link 114 in FIG. 1. The A/D converter 104 receives 916 the unprocessed analog signals and converts 918 these signals to unprocessed digital signals. The unprocessed digital signals are transmitted to the digital processor 106. The digital processor 106 performs 920 a binaural digital signal processing technique to the unprocessed digital signals to generate processed digital signals. Some examples of digital processing techniques are described above. The processed digital signals are transmitted to the D/A converter 108 and are converted 924 to processed analog signals. As described above, the processed analog signals are binaural. That is, the processed analog signal sent to each ear are different from each other and are dependent upon the audio signals received at both ears. The binaural processed analog signals are transmitted 926 to the receiver 110 in each hearing element 604. The receiver 110 receives 928 the analog signals and converts 932 the processed analog signals to processed audio signals that are transmitted to the ear of the user.

Figure 7:
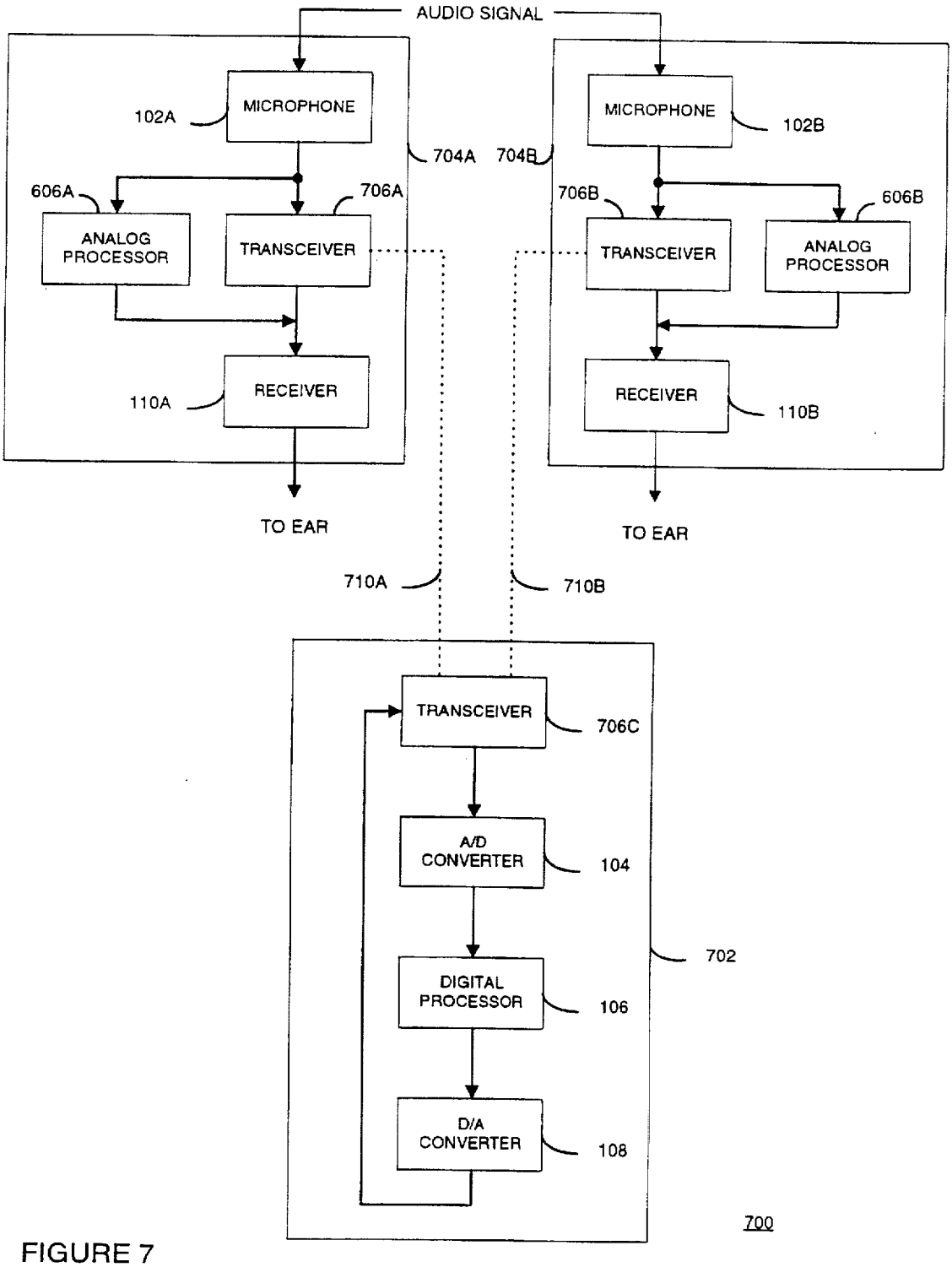
FIG. 7 is a functional block diagram of a hearing aid system according to a preferred embodiment of the present invention where a digital processor is external to each hearing element.

FIG. 7 is a functional block diagram of a hearing aid system 700 according to a preferred embodiment of the present invention where a digital processor 106 is external to each hearing element and uses an electromagnetic communication link 710. The hearing aid system 700 comprises two hearing elements 704A, 704B and an external digital processing unit 702. Each hearing element 704 comprises a microphone 102, an analog processor 606, a receiver 110 and a transceiver 706. These components are described above. The external digital processing unit includes a transceiver 706C, an A/D converter 104, a digital processor 106, and a D/A converter 108.

FIG. 8(*a*) is an illustration of the external digital processing unit 702 according to the embodiment described in FIG. 7. The external digital processing unit 702 includes a transceiver 706C, an A/D converter 104, a digital processor 106, and a D/A converter 108, as described above. In addition, the external digital processing unit 702 includes a power supply 204, a volume switch 802, and a mode switch 804. These additional elements are described above with reference to FIG. 8(*b*).

The operation of the hearing aid system 700 illustrated in FIG. 7 is similar to the operation of the hearing aid system 600 illustrated in FIG. 6, and described above with reference to FIG. 9. One distinction is that the communication between each hearing element 704A, 704B and the external digital processing unit 702 is accomplished by electromagnetic transmission using the transceivers 706. Since the external digital processing unit 702 need not be physically connected to the hearing elements 704, the external digital processing unit can be inconspicuously and comfortably located in a variety of locations, for example, in a suit pocket or on a belt.

In an alternate embodiment of a hearing aid system having an external digital processing unit, the communication link 614, 310 can be digital. This is accomplished by having an A/D converter 104 and a D/A converter 108 in each hearing element 604, 704 instead of in the external digital processing unit 602, 702. In the embodiment having the physical communication link 614, the A/D converter 104 receives the unprocessed analog signals from the microphone 102. The A/D converter 104 converts the analog signals to digital signals that are sent over the communication link via a controller (not shown). Similarly, after the digital processor 106 in the external digital processing unit 602 generates the processed digital signals, these processed digital signals are transmitted back to each hearing element 604. Thereafter, the processed digital signals are converted to processed analog signals using the D/A converter 108 in the hearing element 604 before being sent to the receiver 110. In the embodiment having an electromagnetic communication link 710, the A/D converter 104 is located between the microphone 102 and the transceiver 706 in each hearing element 704. The D/A converter 108 is located between the transceiver 706 and the receiver 110. The transceivers 706A, 706B, 706C control all signal transmission and signal receptions into and out of its associated component.

While the invention has been particularly shown and described with reference to a preferred embodiment and several alternate embodiments thereof, it will be understood by persons skilled in the relevant art that various change in form and details can be made therein without departing from the spirit and scope of the invention.

What is claimed is:

1. A hearing aid comprising:

two audio microphones, each of said audio microphones positioned adjacent to one ear of a user, for receiving audio signals and for converting said audio signals to an analog input signal;

two analog-to-digital converters, for converting said analog input signals to a first digital signal;

a first binaural digital processor, disposed to receive said first digital signal, for selectably performing a binaural processing technique on said first digital signal and generating digital binaural output signals;

two digital-to-analog converters, for converting said digital binaural output signals to analog binaural output signals;

two audio receivers, each disposed to receive said analog binaural output signals, for converting said analog binaural output signals to a filtered audio signal to be transmitted into one of the ears of said user; and a bidirectional communication system, for providing one of said analog input signals and said first digital signal to said first binaural digital processor, said first binaural digital processor performing a monaural processing technique when said bidirectional communication system is not operational.

2. The hearing aid of claim 1, further comprising:

a first hearing element, including:

a first of said two audio microphones, a first of said two audio receivers, a first of said two analog-to digital converters, said first binaural digital processor, and a first of said two digital-to-analog converters; and a second hearing element, including:

a second of said two audio microphones, a second of said two audio receivers, a second of said analog-to-digital converters, a second binaural digital processor, disposed to receive said second digital signal, for selectably performing a binaural processing technique on said second digital signal and generating second digital binaural output signals, said second digital processor performing a monaural processing technique when said bidirectional communication system is not operational, and a second of said digital-to-analog converters.

3. The hearing aid of claim 2, wherein said bidirectional communication system includes a first wire coupling said first hearing element and said second hearing element.

4. The hearing aid of claim 2, wherein said bidirectional communication system includes:

a first transceiver, located in said first hearing element, for converting said analog input signals to first electromagnetic signals, for transmitting said first electromagnetic signals, and for receiving second electromagnetic signals transmitted from a second transceiver located in said second hearing element.

5. The hearing aid of claim 2, wherein said bidirectional communication system includes:

a first transceiver, located in said first hearing element, for converting said first digital signals to first electromagnetic signals, for transmitting said first electromagnetic signals, and for receiving second electromagnetic signals transmitted from a second transceiver located in said second hearing element.

6. The hearing aid of claim 2, wherein said first binaural digital processor performs a first portion of said binaural processing technique and said second binaural digital processor performs a second portion of said binaural processing technique.

7. The hearing aid of claim 6, further comprising a digital communications link disposed to transmit digital signals to and to receive digital signals from each of said first binaural digital processor and said second binaural digital processor.

8. The hearing aid of claim 2, further comprising:

a first analog processing system, coupled to said first audio microphone, for performing an analog processing technique on said analog input signal when said first binaural digital processor is not implemented;

a second analog processing system, coupled to said second audio microphone, for performing an analog processing technique on said analog input signal when said second binaural digital processor is not implemented.

9. The hearing aid of claim 1, further comprising:

a first hearing element, coupled to said bidirectional communication system, having:

a first of said two audio microphones, a first of said two audio receivers, and said first binaural digital processor; and a second hearing element, having:

a second of said two audio microphones, a second of said two audio receivers.

10. The hearing aid of claim 9, wherein said bidirectional communication system includes:

a wire connecting said first hearing element and said second hearing element.

11. The hearing aid of claim 9, wherein said bidirectional communication system includes:

a first transceiver, located in said first hearing element, for converting said analog input signals to first electromagnetic signals, for transmitting said first electromagnetic signals, and for receiving second electromagnetic signals; and a second transceiver, located in said second hearing element, for converting said analog input signals to second electromagnetic signals, for transmitting said second electromagnetic signals, and for receiving said first electromagnetic signals.

12. The hearing aid of claim 9, wherein said bidirectional communication system includes:

a first transceiver, located in said first hearing element, for converting said first digital signals to first electromagnetic signals, for transmitting said first electromagnetic signals, and for receiving second electromagnetic signals; and a second transceiver, located in said second hearing element, for converting said first digital signals to second electromagnetic signals, for transmitting said second electromagnetic signals, and for receiving said first electromagnetic signals.

13. The hearing aid of claim 1 further comprising:

a first hearing element, having:

a first of said two audio microphones, a first of said two audio receivers, and a first analog processing system, coupled to said first audio microphone, for performing an analog processing technique on said analog input signal when said first binaural digital processor is not implemented;

a second hearing element, having:

a second of said two audio microphones, a second of said two audio receivers, and a second analog processing system, coupled to said second audio microphone, for performing an analog processing technique on said analog input signal when said first binaural digital processor is not implemented; and a first unit having a power supply, and said first binaural digital processor coupled to said power supply.

14. The hearing aid of claim 13, wherein said first unit further comprises a digital processor mode selection means, coupled to said first binaural digital processor, for selecting one of a plurality of binaural digital processing techniques to be implemented by said first binaural digital processor.

15. The hearing aid of claim 13, wherein said bidirectional communication system includes:

a first wire connecting said first binaural digital processor and said first element; and a second wire connecting said first binaural digital processor and said second element.

16. The hearing aid of claim 13, wherein said bidirectional communication system includes:

a first transceiver located in said first hearing element and a second transceiver located in said second hearing element, said first transceiver and said second transceiver for converting said analog input signals to first electromagnetic signals, for transmitting said first electromagnetic signals, and for receiving a second electromagnetic signal; and a third transceiver located in said first unit, for receiving said first electromagnetic signals transmitted from said first transceiver and said second transceiver, for converting said first electromagnetic signals to said analog input signal, for converting said analog binaural output signals to said second electromagnetic signals, and for transmitting said second electromagnetic signals.

17. The hearing aid of claim 13, wherein said bidirectional communication system includes:

a first transceiver located in said first hearing element and a second transceiver located in said second hearing element, said first transceiver and said second transceiver for converting said first digital signals to first electromagnetic signals, for transmitting said first electromagnetic signals, and for receiving a second electromagnetic signal; and a third transceiver located in said first unit, for receiving said first electromagnetic signals transmitted from said first transceiver and said second transceiver, for converting said first electromagnetic signals to said first digital signals, for converting said digital binaural output signals to said second electromagnetic signals, and for transmitting said second electromagnetic signals.

18. A hearing aid system comprising:

a hearing element, including:

a first audio microphone, positioned adjacent to one ear of a user, for receiving an audio signal and for converting said audio signal to an analog input signal, a first analog processing system, coupled to said first audio microphone, for performing an analog processing technique on said analog input signal when a first binaural digital processor is not utilized, and a first audio receiver, for converting an analog output signal to a filtered audio signal to be transmitted into one of the ears of said user;

a detachable first unit having:

a power supply, a first analog-to-digital converter for converting said analog input signals to a first digital signal, said first binaural digital processor, disposed to receive said first digital signal, for selectably performing a binaural digital processing technique on said first digital signal and generating a binaural digital output signal, and a first digital-to-analog converter for converting said binaural digital output signal to a binaural analog output signal; and a bidirectional communication system for coupling said first hearing element and said first unit, said first binaural digital processor performing a monaural processing technique when said bidirectional communication system is not operational.

19. The hearing aid system of claim 18, further comprising:

a first transceiver located in said first hearing element, for converting said first digital signal to a first electromagnetic signal, for transmitting said first electromagnetic signal, and for receiving a second electromagnetic signal; and a second transceiver located in said first unit, for receiving said first electromagnetic signal, for converting said first electromagnetic signal to said first digital signal, for converting said binaural digital output signal to said second electromagnetic signals, and for transmitting said second electromagnetic signals.

20. The hearing aid of claim 18, wherein said bidirectional communication system includes a wire, coupled between said first hearing element and said detachable first unit.

21. A hearing aid comprising:

a first hearing element, including:

a first audio microphone positioned adjacent to one ear of a user, for receiving a first set of audio signals and for converting said first set of audio signals to a first analog input signal;

a first analog-to-digital converter, for converting said first analog input signal to a first digital signal;

a first binaural digital processor, disposed to receive said first digital signal and a second digital signal, for selectably performing a binaural processing technique on said first and second digital signals and generating first and second digital binaural output signals;

a first digital-to-analog converter, for converting said first digital binaural output signal to a first analog binaural output signal; and a first audio receiver disposed to receive said first analog binaural output signal, for converting said first analog binaural output signal to a first filtered audio signal to be transmitted into one of the ears of said user;

a second hearing element, including:

a second audio microphone positioned adjacent to one ear of a user, for receiving a second set of audio signals and for converting said second set of audio signals to a second analog input signal;

a second analog-to-digital converter, for converting said second analog input signal to the second digital signal;

a second digital-to-analog converter, for converting said second digital binaural output signal to a second analog binaural output signal;

a second audio receiver disposed to receive said second analog binaural output signal, for converting said second analog binaural output signal to a second filtered audio signal to be transmitted into one of the ears of said user; and a power supply coupled to said first binaural digital processor; and a bidirectional communication system, for providing said second digital signal to said first binaural digital processor.

* * * * *